US006600242B1

(12) United States Patent
Dennison

(10) Patent No.: US 6,600,242 B1
(45) Date of Patent: Jul. 29, 2003

(54) METHOD AND APPARATUS FOR DETERMINING SWITCH STATUS

(75) Inventor: Stephen G Dennison, Solihull (GB)

(73) Assignee: Lucas Industries Limited, Solihull (GB)

( * ) Notice: Subject to any disclaimer, the term of this patent is extended or adjusted under 35 U.S.C. 154(b) by 191 days.

(21) Appl. No.: 09/641,596

(22) Filed: Aug. 18, 2000

(30) Foreign Application Priority Data

Aug. 26, 1999 (GB) ..... 9920143

(51) Int. Cl.[7] ..... H01H 1/60
(52) U.S. Cl. ..... 307/125; 700/13; 200/1 R
(58) Field of Search ..... 307/125, 134, 307/137; 700/13; 200/1 R, 235

(56) References Cited

U.S. PATENT DOCUMENTS

| | | | | | |
|---|---|---|---|---|---|
| 3,713,104 | A | * | 1/1973 | Stich | 340/2.2 |
| 4,677,308 | A | * | 6/1987 | Wroblewski et al. | 307/10.1 |
| 5,192,873 | A | * | 3/1993 | Wrenbeck et al. | 307/10.1 |
| 5,258,654 | A | * | 11/1993 | Roberts et al. | 307/125 |
| 5,574,385 | A | * | 11/1996 | Murphy et al. | 324/765 |
| 5,729,167 | A | * | 3/1998 | Kujawa et al. | 307/137 |
| 5,749,055 | A | * | 5/1998 | Dahlin | 455/439 |
| 5,761,918 | A | * | 6/1998 | Jackson et al. | 62/181 |
| 5,912,566 | A | * | 6/1999 | Tamura | 327/18 |
| 6,242,821 | B1 | * | 6/2001 | Macks | 307/125 |
| 2003/0038017 | A1 | * | 2/2003 | Boyer et al. | 200/1 R |

FOREIGN PATENT DOCUMENTS

| | | | | |
|---|---|---|---|---|
| EP | 0784329 | A1 | 7/1997 | |
| EP | 1079401 | A2 * | 9/2001 | H01H/1/60 |
| WO | WO9728550 | A | 8/1997 | |

OTHER PUBLICATIONS

"Multiple Switch Detection Interface PC33993DWB Technical Data", Dec. 2002, Motorola.*

* cited by examiner

*Primary Examiner*—Brian Sircus
*Assistant Examiner*—Roberto J. Rios
(74) *Attorney, Agent, or Firm*—Andrus, Sceales, Starke & Sawall, LLP

(57) ABSTRACT

A method for determining the status of a plurality of in a circuit, each switch having first switching arrangement for controlling the supply of a wetting current to the respective switch, and a second switching arrangement, whereby closure of the second switching arrangement enables the status of the respective switch to be determined, the method including the steps of closing the first switching arrangement associated with each of the switches so as to supply a wetting current to each of the switches and, when each one of the first switching arrangements is closed, closing the second switching arrangement associated with the same switch in order to determine the switch status. The invention also relates to an apparatus for determining the status of a plurality of switches.

13 Claims, 1 Drawing Sheet

METHOD AND APPARATUS FOR DETERMINING SWITCH STATUS

BACKGROUND OF THE INVENTION

The invention relates to a method for determining the status of a plurality of switches. The invention also relates to an apparatus for determining the status of a plurality of switches.

In aircraft engine control systems, various switches are used to feed back different aspects of engine and/or airframe condition, the engine control system commonly being controlled by an electronic control unit (ECU). The closing of a switch against a respective switch contact causes a current to pass through the closed switch path to indicate, for example, an overload or limit, or an action by the aircraft pilot. During operation of the engine control system, there is often a need to be able to determine whether the switches are in an open or closed position.

Conventionally, switch status is determined by means of a circuit, forming part of the electronic control unit, which periodically supplies a "wetting" current to all of the external switches in the control system by means of an arrangement of primary switches. The wetting current is supplied to each switch via an associated resistor by closing the primary switches. The electrical circuit includes an arrangement of secondary switches, one secondary switch being associated with each of the external switches. By closing the secondary switches, the current flowing through the closed secondary switch path provides an indication of the external switch status.

In order to prevent oxidisation and debris build-up on the external switch contacts, it is necessary to ensure a current of at least 4 mA is supplied to the closed external switch contacts. Oxidisation and debris build-up on the switch contacts can occur for smaller currents than this and results in a degradation in performance and reliability of the external switches.

However, with larger currents flowing through the closed external switches, a significant power loss occurs across the internal resistors of the ECU. This gives rise to undesirable heating effects which can adversely effect the thermal management of the electronic control unit and can degrade the performance and reliability of overheat protection circuitry contained therein. A problem therefore exists with the conventional method of determining switch status in that a compromise must be made between the most desirable wetting current for reduced heat loss and the most desirable wetting current for reliable switch operation.

SUMMARY OF THE INVENTION

It is an object of the present invention to provide a method and apparatus for determining switch status which alleviates the problems of the prior art.

According to one aspect of the present invention, there is provided a method for determining the status of a plurality of switches in a circuit, each switch having a first switching means for controlling the supply of a wetting current to the respective switch, and second switching means, closing of the second switching means enabling the status of the respective switch to be determined, the method including the steps of closing the first switching means associated with each of the switches so as to supply a wetting current to each of the switches and, when each one of the first switching means is closed, closing the second switching means associated with the same switch in order to determine switch status.

Preferably, the duration for which each pair of the first and second switching means is closed is chosen so as to minimise power dissipation.

Conveniently, the method of the present invention may be used to determine whether each of the switches in the circuit is open or closed. The duration is chosen to be sufficient to accurately determine the switch status. Preferably, the duration for which each pair of the first and second switching means is closed is between 50 $\mu$s and 1 ms and, typically, may be 500 $\mu$s.

In a preferred embodiment, the wetting current is supplied to each switch in sequence, the status of the switches being determined sequentially.

The method provides the advantage that, as the wetting current is only supplied to the switches in the circuit as a pulse of short duration rather than continuously, heat losses due to resistances within the circuit are reduced. Thus, higher wetting currents can be used than with conventional methods. It has been found that this improves the performance and reliability of the method.

A further improvement is obtained by supplying the wetting current to the switches sequentially rather than at the same time.

Additionally, the method may include the further steps of reading the status of each switch and storing it in the form of a single bit in a register when the associated second switching means is closed and, prior to closing the first and second switching means associated with the next switch in the sequence, shifting the contents of the register by one register location.

Preferably, the method may include the further step of outputting the contents of the register when the register contains the status of all of the switches. Alternatively, the ECU may be arranged to access the data stored in the register at any desired time.

The method provides the further advantage that, as the status of each of the switches is determined one after the other, a simplified read-out register arrangement is required. Conventionally, if the status of all the external switches is determined at the same time, a read-out register is required for each switch.

The switches may form part of an engine and/or airframe control function. However, the method may be used for determining the status of switches in any circuit.

The first and second switching means preferably take the form of first and second multiplexer switch arrangements, the first multiplexer switch arrangement comprising a plurality of first switches and the second multiplexer switch arrangement comprising a plurality of second switches.

According to a second aspect of the present invention, there is provided an apparatus for determining the status of a plurality of switches in a circuit, comprising;

- a first switching means associated with each switch for controlling the supply of a wetting current to the respective switch;
- a second switching means associated with each switch, whereby closing of the second switching means enables the status of the respective switch to be determined; and
- means for addressing the first and second switching means so as to switch the first and second switching means between open and closed positions such that the first and second switching means associated with a common switch are closed at substantially the same time.

Preferably, the first and second switching means associated with a common switch are closed at substantially the same time, for a period of relatively short duration.

Preferably, the pairs of first and second switching means associated with each switch are operated sequentially.

The apparatus may also include a register into which the status of each of the switches is output. The contents of the register can conveniently be read-out when one sequence has been completed and the status of all of the switches has been determined.

Preferably, the apparatus comprises a first multiplexer switch arrangement and a second multiplexer switch arrangement, the first multiplexer switch arrangement comprising a plurality of first switches, each one of the first switches being operable to control the supply of a wetting current to an associated one of the switches, the second multiplexer switch arrangement comprising a plurality of second switches, each of the second switches being operable to enable the status of an associated switch to be determined.

BRIEF DESCRIPTION OF THE DRAWINGS

The invention will now be described, by way of example only, with reference to the accompanying FIG. 1 which is a schematic diagram of a circuit in accordance with one aspect of the present invention.

DETAILED DESCRIPTION OF THE INVENTION

Figure 1:
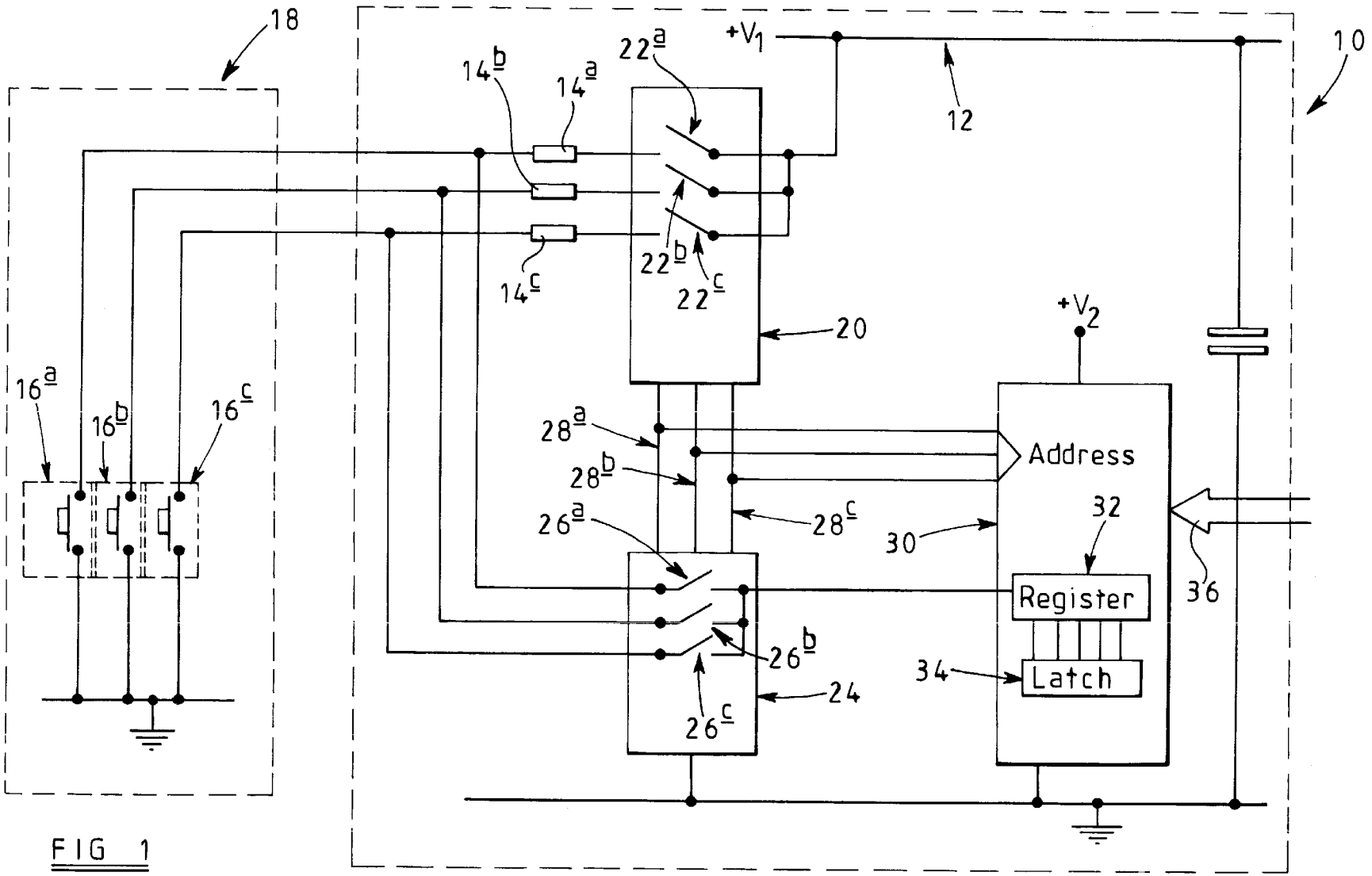

Referring to FIG. 1, an electrical circuit, referred to generally as 10, includes a voltage supply rail 12 for supplying a voltage, $+V_1$, across a plurality of resistors 14*a*, 14*b*, 14*c*. Each of the resistors 14*a*, 14*b*, 14*c* is associated with an external switch 16*a*, 16*b*, 16*c* respectively within an external control circuit, referred to generally as 18, one side of each resistor 14*a*, 14*b*, 14*c* being connected to one contact of the respective switch 16*a*, 16*b*, 16*c*. The other side of each switch 16*a*, 16*b*, 16*c* is connected to ground. The electrical circuit 10 may be contained within an electronic control unit (not shown) for controlling the operation of an associated engine. Each of the switches 16*a*, 16*b*, 16*c* in the external circuit 18 is operable between open and closed positions to provide status information regarding various aspects of engine and/or airframe operation. The function of the switches 16*a*, 16*b*, 16*c* is beyond the scope of the present invention and will not be described in further detail.

The circuit 10 also includes first and second multiplexer switch arrangements 20, 24, the first multiplexer switch arrangement 20 comprising a plurality of first switches 22*a*, 22*b*, 22*c* and the second multiplexer switch arrangement 24 comprising a plurality of second switches 26*a*, 26*b*, 26*c*. One contact of each of the first switches 22*a* 22*b*, 22*c* is permanently connected to the voltage rail 12, the other contact of each of the first switches 22*a*, 22*b*, 22*c* being connectable with one side of a respective one of the resistors 14*a*, 14*b*, 14*c*. The other side of each of the resistors 14*a*, 14*b*, 14*c* is connected to one of the external switches 16*a*, 16*b*, 16*c* respectively and, in addition, is in connection with one contact of a respective one of the second switches 26*a* 26*b*, 26*c*.

Each of the second switches 26*a*, 26*b*, 26*c* shares a common address line 28*a*, 28*b*, 28*c* with an associated one of the first switches 22*a*, 22*b*, 22*c*. In use, the address lines 28*a*, 28*b*, 28*c* for addressing associated ones of the first and second switches, 22*a* and 26*a*, 22*b* and 26*b*, 22*c* and 26*c*, are provided with address pulses by means of an application specific integrated circuit (ASIC) 30 which forms part of circuit 10, the ASIC 30 being connected to a voltage supply, +V2. In use, the common address lines 28*a*, 28*b*, 28*c* are addressed in turn by address pulses supplied by the ASIC 30, the ASIC controlling both the duration of the address pulse applied to the common address lines 28*a*, 28*b* 28*c*, and the time period between sequential address pulses. Alternatively, in place of the ASIC, a Field Programmable Gate Array (FPGA), may be used.

The ASIC 30 also includes a register 32, one contact of each of the second switches 26*a*, 26*b*, 26*c* being connectable with the register 32 such that, when any one of the second switches 26*a*, 26*b*, 26*c* is in the closed position, the voltage across the closed switch is input to the register 32. The analogue value of the voltage across each of the second switches 26*a*, 26*b*, 26*c* is converted to digital form by suitable analogue to digital conversion means (not shown) prior to input to the register 32. In addition, the ASIC 30 includes a latch 34 into which the contents of the register 32 are latched for access by a computer processor data bus 36.

In order to determine the status of the switches 16*a*, 16*b*, 16*c* in the external circuit 18, the circuit 10 shown in FIG. 1 is operated in the following way. During the first stage of the operating cycle, the ASIC 30 addresses the common address line 28*a* causing the first switch 22*a* and second switch 26*a* to be closed at substantially the same time. The voltage $V_1$ is therefore applied across the resistor 14*a* and a wetting current, determined by the value of the resistor 14*a* and the voltage $V_1$, is supplied to the external switch 16*a*. If the external switch 16*a* is open when the first and second switches 22*a*, 26*a* are closed, the contact of the external switch 16*a* connected to the resistor 14*a* will be at a relatively high voltage, this voltage being fed to the second switch 26*a*and the register 32, and stored, for example, in the form of a logic "1". However, if the switch 16*a* is closed, then the voltage at the contact of the switch 16*a* connected to the resistor 14*a* will be relatively low, and this low voltage will be fed through the second switch 26*a* to the register 32 where it is stored, for example in the form of a logic "0". The voltage level input to the register 32 therefore provides an indication of whether the external switch 16*a* is open or closed.

After a predetermined time period determined by the ASIC 30, typically between 50 $\mu$s and 1 ms, the first bit of the register 32 is shifted by one place so that the register 32 is ready for a subsequent input. In addition, the address pulse applied to the common address line 28*a* is removed causing the first and second switches 22*a*, 26*a* to open. The wetting current is therefore no longer applied to the external switch 16*a*.

During the next stage of the operating cycle, the ASIC 30 applies an address pulse to the common address line 28*b* causing the first and second switches 22*b*, 26*b* to close. As the first switch 22*b* is closed, a current flows through the resistor 14*b* and a wetting current is supplied to the external switch 16*b*. As described previously, a signal indicative of the voltage value is input to the register 32 which provides an indication of the status of the switch 16*b*. As in the first stage of the operating cycle, after the predetermined time period, the ASIC 30 removes the address pulse from the second common address line 28*b* and the contents of the register 32 are again shifted by one place.

Finally, during the third stage of the operating cycle, the ASIC 30 applies an address pulse to the common address line 28*c* causing the first and second switches 22*c*, 26*c* to be closed. As described previously for the external switch 16*a*, the signal indicative of the voltage value is input to the register 32 and provides an indication of the status of the external switch 16*c*. After the predetermined time period, the contents of the register 32 are shifted to the latch 34 such that the latch 34 contains information regarding the status of all three of the external switches 16*a*, 16*b*, 16*c*.

The process may be repeated for any number of switches.

Once the operating cycle has been completed, and the latch 34 contains the status of each of the external switches 16*a*, 16*b*, 16*c*, the switch status information held in the latch 34 is read by the computer via bus 36. The reading of the latch contents provides a signal to the ASIC 30 to repeat the operating cycle, and an address pulse is again applied to the common address line 28*a* and the procedure is repeated. As the status of the external switches 16*a*, 16*b*, 16*c* is determined by supplying a wetting current pulse to each of the switches, rather than supplying a continuous wetting current, power loss is reduced. The loss is further improved by using the multiplexed, sequential method described hereinbefore in which power loss only occurs across one of the resistors 14*a*, 14*b*, 14*c*, at any one time. This reduces the amount of heat generated within the electronic control unit, thereby improving thermal management of the unit.

The values of the resistors 14*a*, 14*b*, 14*c* are selected such that the wetting current supplied to the external switches 16*a*, 16*b*, 16*c* is greater than that which will cause oxidisation effects and debris build up on the switch contacts. A wetting current of 4 mA is adequate, but it has been found that the effects of oxidisation and debris build-up on the switch contacts can be improved further if the wetting current is at least 10 mA. As the wetting current is supplied to the external switches as a pulse, the present invention permits an increased wetting current to be used without creating an excessive undesirable heat loss across the resistors 14*a*, 14*b*, 14*c*.

It will be appreciated that the invention may be used with an external circuit having any number of switches for which the status is to be determined and is not limited to the number described hereinbefore. In each case, a corresponding number of first and second switches to the number of external switches is provided in the circuit 10 so that each has an associated first and second switch controlled by a common address line. It will be further appreciated that the switches of the circuit 18 may form part of the circuit 10 and need not be external thereto. Additionally, the electrical circuit 10 need not be incorporated within the electronic control unit but may be a separate circuit.

The invention may also be applied to relays in which secondary relay contacts are provided to give feed back regarding the status of the relay output. The secondary relay contacts have to carry at least a certain proportion of the primary relay current and hence there will be significant power dissipation in the secondary contact limit resistor. The use of the pulsed method described hereinbefore gives a reduced power dissipation, and the use of the sequential method further reduces the power dissipation.

I claim:

1. A method for determining the status of a plurality of switches in a circuit, each switch having associated therewith a first switching arrangement for controlling the supply of a wetting current to the respective switch, and a second switching arrangement, whereby closure of the second switching arrangement enables the status of the respective switch to be determined, the method including the steps of:

briefly closing the first switching arrangement associated with each of the switches so as to supply a short duration pulse of wetting current to each of the switches and, during a period of closure of each one of the first switching arrangements, closing the associated second switching arrangement said switch in order to determine the status of said switch.

2. The method as claimed in claim 1, wherein each switch has an associated resistor, wherein the duration for which each associated first switching arrangements is closed is selected so as to minimize power dissipation across the resistor associated with the closed switch.

3. The method as claimed in claim 1, whereby the method is performed to determine whether each of the switches in the circuit is open or closed.

4. The method as claimed in claim 1, wherein the wetting current is supplied to each switch in sequence, so as to determine the status of the switches sequentially.

5. The method as claimed in claim 1, wherein the wetting current is at least 4 mA.

6. The method as claimed in claim 5 wherein the wetting current is substantially 10 mA.

7. The method as claimed in claim 1, including the further steps of reading the status of each switch and storing it in a register when the associated second switching arrangement is closed and, prior to closing the first and second switching arrangement associated with the subsequent switch in the sequence, shifting the contents of the register by one register location.

8. The method as claimed in claim 7, comprising the further step of outputting the contents of the register when the register contains the status of all of the switches.

9. The method as claimed in claim 7, comprising the further step of accessing the contents of the register by means of an electronic control unit.

10. An apparatus for determining the status of a plurality of switches in a circuit, comprising;

a first switching arrangement associated with each switch for controlling the supply of a wetting current to the respective switch;

a second switching arrangement associated with each said switch, whereby closure of the second switching arrangement enables the status of the respective switch to be determined; and an arrangement for addressing the first and second switching arrangement so as briefly to switch the first and second switching arrangements between open and closed positions such that the first and second switching arrangements associated with a common switch are closed at substantially the same time.

11. The apparatus as claimed in claim 10, further comprising a register into which the status of each of the switches is output.

12. The apparatus as claimed in claim 10, comprising a first multiplexer switch arrangement and a second multiplexer switch arrangement, the first multiplexer switch arrangement comprising a plurality of said first switching arrangements, each one of said first switching arrangements being operable to control the supply of a wetting current to an associated one of the switches, the second multiplexer switch arrangement comprising a plurality of second switching arrangements, each of the second switching arrangements being operable to enable the status of an associated said switch to be determined.

13. The apparatus as claimed in claim 10, wherein the arrangement for addressing the first and second switching arrangements comprises an integrated circuit.

* * * * *